169-46

6/23/87 XR 4,675,203 SR

United States Patent [19]

Scarbrough

[11] Patent Number: 4,675,203

[45] Date of Patent: Jun. 23, 1987

[54] SYSTEM FOR DETECTING FIRE IN A POWDER SPRAY BOOTH

[75] Inventor: Don R. Scarbrough, Elyria, Ohio

[73] Assignee: Nordson Corporation, Amherst, Ohio

[21] Appl. No.: 849,576

[22] Filed: Apr. 8, 1986

[51] Int. Cl.[4] ..... B05B 12/12; B05B 5/02; B05D 1/06

[52] U.S. Cl. ..... 427/27; 118/629; 118/663; 169/46; 169/59; 239/691

[58] Field of Search ..... 169/42, 46, 54, 65, 169/56-61; 118/663, 666, 629; 427/27

[56] References Cited

U.S. PATENT DOCUMENTS

| | | | |
|---|---|---|---|
| 2,024,316 | 12/1935 | Theissing | 169/59 |
| 2,752,095 | 6/1956 | Puster . | |
| 3,174,496 | 3/1965 | Hoeppel . | |
| 3,800,816 | 4/1974 | Follett . | |
| 3,824,374 | 7/1974 | Mayher | 169/65 X |
| 3,889,756 | 6/1975 | Dunn . | |
| 4,193,416 | 3/1980 | Slawson . | |
| 4,276,064 | 6/1981 | Gerdes . | |
| 4,281,790 | 8/1981 | McGinnis . | |
| 4,356,868 | 11/1982 | Bentley et al. . | |

*Primary Examiner*—Jeffrey V. Nase

*Attorney, Agent, or Firm*—Wood, Herron & Evans

[57] ABSTRACT

A system for detecting fire in a powder spray booth having a spray gun for depositing powder onto products moving through the booth includes a switch mounted to the spray gun which is operatively connected to a control system which operates the booth and controls the supply of powder to the spray guns. A spring biases the switch toward an open, operating position in which a signal is sent to the control system to shut down the booth operation and powder supply. Under normal operating conditions, the spring force is overcome by a switch closure mechanism which comprises a fixed rod, and a movable rod mounted to the switch which is pulled toward the fixed rod to close the switch by a burnable filament extending between the rods and positioned in the path of the powder discharged from the spray gun. If a fire starts in the booth, the burnable filament is immediately destroyed and releases the movable rod so that the spring is permitted to move the switch to the open position. In turn, the switch sends a signal to the control system to shut down the supply of powder to the spray guns to extinguish the fire.

11 Claims, 2 Drawing Figures

SYSTEM FOR DETECTING FIRE IN A POWDER SPRAY BOOTH

BACKGROUND OF THE INVENTION

This invention relates to powder spray systems, and, more particularly, to a system for detecting fire within a powder spray booth and initiating a shut down of the operation of the booth to extinguish the fire.

The process of coating products with a solid resin coating involves preparing the resin coating in a finely ground powdered form and spraying it onto the products in a manner similar to liquid paint. Conventionally, an electrostatic charge is applied to the sprayed powder to enhance the attraction of the powder to the products which are held at ground potential. The electrostatic charge maintains the powder upon the part for a sufficient time period to permit the powder to be heated so that it melts, and when subsequently cooled, is firmly attached to the product.

In most applications, powder deposition is performed in a booth which provides a controlled area from which any oversprayed powder not deposited on the article is collected. Spray guns mounted in the booth and connected to a source of air-entrained powder, such as a powder feed hopper and powder pump, spray powder onto articles moving through the booth which are suspended from an overhead conveyor. Hooks or other supports carried by the overhead conveyor support the articles within the booth and maintain the articles at ground potential to attract the electrostatically-charged powder discharged from the spray guns.

Solid resin coating in finely ground, powdered form is highly combustible and can be ignited within the spray booth by sparks from an article which is not properly grounded. The powder supplied from the spray guns, the powder deposited onto the articles and the powder collected on the sides and floor of the booth all provide a source of fuel for a fire in the spray booth. If such fires are not extinguished immediately, the booth, spray guns and auxiliary equipment can be severely damaged.

Fire detection systems for powder spray booths have been in use for several years to detect a fire within the booth and immediately shut down all systems associated with the booth, including the supply of powder to the spray guns, to extinguish the fire. One of the most commonly used fire detection systems is an ultraviolet light or UV detector mounted at the ceiling of the booth and operatively connected to a controller which controls the powder spray booth systems, including the exhaust system, the high voltage supply, the compressed air supply, the product conveyor and the powder feed system.

Fire and electrostatic sparks produce a narrow band or ultraviolet light. The UV light detectors are tuned to this band so that when a fire is ignited within the booth, the UV detector senses the fire and immediately sends a signal to the controller which shuts down all of the systems associated with the powder booth. When properly used, UV light detector systems have proven effective in quickly extinguishing fires within powder spray booths.

One limitation of UV fire detection systems is that the cost is often prohibitive for smaller spray booths employing two or three spray guns. In such applications, the UV light detection system is often more expensive than the powder application system. As a result, many operators of small powder booths have refused to employ any fire detection system and this has resulted in damaging fires.

Another problem with UV light detection systems relates to their sensitivity. As mentioned above, UV light detectors are tuned to detect the small band of ultraviolet light produced by a fire or an electrostatic spark and then send a signal to the controller to shut down all systems associated with the booth. In some instances, an improperly grounded article will produce sparks which can be detected by the UV light detector but which are not situated within a cloud of dust concentrated enough to start a fire. The UV detector sends a signal to the controller to shut down the booth systems, but no fire has occurred in the booth.

In another case stray UV light from an electric arc welding operation or from sparking electrical contacts in nearby industrial equipment may be detected and cause a shut down.

In these instances, the operator of the booth may assume that the UV detector is not functioning properly because no fire had started in the booth. To continue with production, the operator often bypasses the UV detector and then runs the booth without any fire detection system. If a fire now occurs, there is no provision for automatic shut down of the booth operation and the fire can cause substantial damage to the booth and spray guns before it can be manually extinguished.

One attempt which has been made to simplify and reduce the cost of fire detection systems involves the placement of a fusible or burnable line near the ceiling of the booth which is connected to a switch adapted to send a signal to the controller of the spray booth. In the event of a fire in the booth, the line will burn through and activate the switch so that a signal is sent to the controller to shut down the booth operation.

The problem with this approach is that most of the fires in powder spray booths occur at or near the powder spray guns because they are closest to an improperly grounded article which can produce sparks and are discharging large quantities of powder onto the article. A substantial amount of damage to the booth and spray guns can occur in a fire beginning in the area of the spray guns before it finally reaches the ceiling of the booth and burns the detection line of such prior art detection system.

SUMMARY OF THE INVENTION

It is therefore among the objects of this invention to provide a system for detecting and then extinguishing fires within a powder spray booth which is relatively inexpensive, which is simple in operation and which is located at the spray guns where fires are most likely to begin to immediately detect and initiate procedures to extinguish the fire.

These objectives are accomplished in a fire detection system in which a switch operatively connected to the controller of a powder spray booth is held in a closed position by a switch closure means mounted to the powder spray gun within the booth. In the event a spark ignites the powder ejected from the spray gun and starts a fire, the switch closure means is rendered inoperative which permits the switch to move to an open position wherein a signal is sent to the controller which shuts down all operations of the booth to extinguish the fire.

More specifically, an explosion-proof dust-tight switch mounted to the powder spray gun in the booth is movable between a normally open position and a closed position. The switch is operable in the open position to send a signal to the controller to shut down all systems associated with the booth including the exhaust system, compressed air supplies, conveyor system, the source of high voltage to the spray guns and the source of powder to the spray guns.

Biasing means in the form of a spring is connected to the switch to urge it to the normally open position. The force applied to the switch by the spring is overcome by switch closure means, mounted in the path of the powder discharged from the spray guns, which maintains the switch in a closed position unless a fire begins in the booth. If a spark from an improperly grounded article starts a fire, the switch closure means is immediately rendered inoperative and allows the spring to return the switch to an open position to send the shut-down signal to the control system.

In a presently preferred embodiment, the switch closure means comprises a lower rod fixedly mounted to the spray gun and having an outer end extending forwardly of the nozzle of the spray gun. An upper rod is mounted to the switch and is movable therewith between an open and closed position. The outer end of the upper rod also extends forwardly of the spray gun nozzle and is spaced from the outer end of the first rod. A fusible or burnable line or filament is wrapped between the upper and lower rods and tensioned so that the upper rod is pulled toward the fixed, lower rod to move the switch to a closed position. Preferably, the line is positioned in the path of the powder discharged from the nozzle. Both rods and the filament are structured of electrically non-conductive materials to avoid interference with the spray process due to electrostatic attration, or presentation of an ignition hazard due to stored capacitance.

Under normal operating conditions, the filament retains the upper rod in a position relative to the fixed, lower rod so that the switch is maintained in a closed position. In the event a spark from an article moving past the spray gun ignites the powder discharged from the nozzle, the filament is immediately severed which permits the spring acting on the movable upper rod to return the switch to an open position. In the open position, the switch sends a signal to the control system to shut down all systems of the booth.

In a presently preferred embodiment, the filament is a co-extruded filament having a rigid polyester core and an outer jacket formed of nylon. Since the filament is disposed in the powder spray path and must overcome the force of the spring urging the switch to an open position, the filament must have both good abrasion resistance and also resistance to stretching. The nylon portion of the co-extruded filament provides the required abrasion resistance, but, since it is stretchable, the core of polyester material is needed to add rigidity to the filament. The polyester core is not suitable for use alone because its abrasion resistance is poor.

The fire detection system of this invention provides a relatively simple, inexpensive alternative to UV detection systems which are prohibitively expensive in relatively small powder spray booths with only two or three spray guns. Since the filament is mounted closely adjacent the nozzle of the spray gun, in the path of the powder discharged from the nozzle, it is immediately burned in the event of a fire. This provides for immediate detection of the fire so that it can be quickly extinguished before the booth is damaged.

DETAILED DESCRIPTION OF THE DRAWINGS

Figure 1:
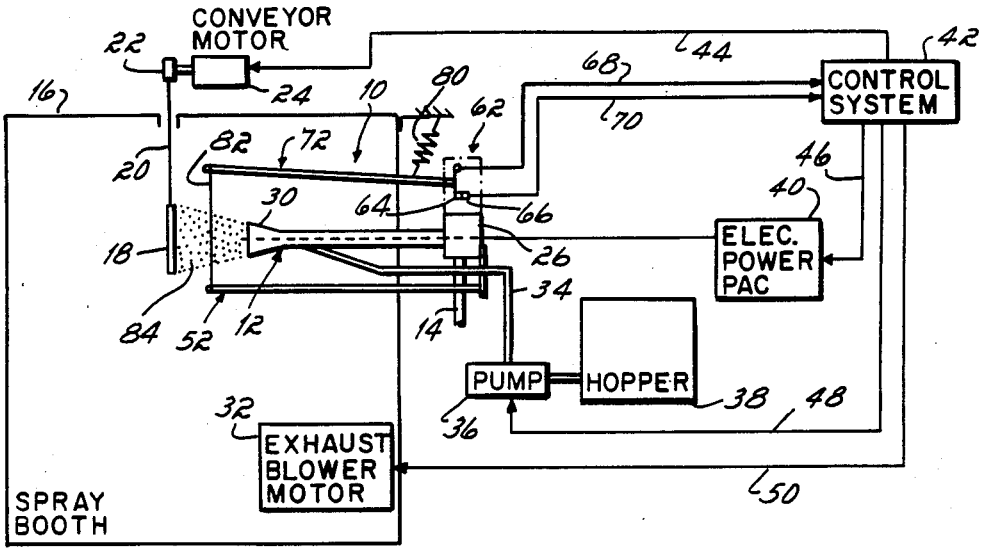
Figure 2:
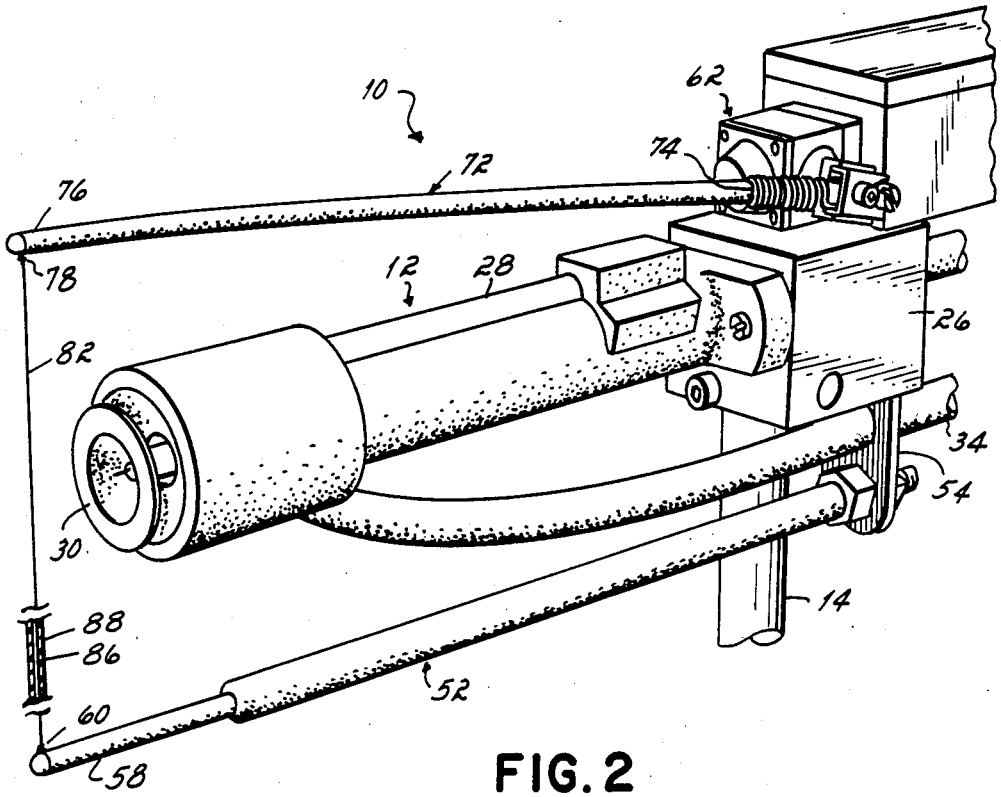

The structure, operation and advantages of a presently preferred embodiment of this invention will become further apparent upon consideration of the following description taken in conjunction with the accompanying drawings, wherein:

FIG. 1 is a schematic front view of a powder spray gun and associated systems incorporating the fire detection system of this invention; and FIG. 2 is an enlarged, isometric view of a powder spray gun and fire detection system herein as shown in FIG. 1.

DETAILED DESCRIPTION OF THE INVENTION

Referring now to the figures, the fire detection system 10 of this invention is mounted to a powder spray gun 12 which is supported by a rod 14 within a powder spray booth 16 for spraying powder onto articles 18 moving through the booth 16. The articles 18 are supported by hooks 20 carried on an overhead conveyor 22 driven by a motor 24. The powder spray gun 12 is conventional and includes a rear mounting block 26, a gun barrel 28 supported by the mounting block 26 and a nozzle 30 mounted at the forward end of the barrel 28. The powder spray booth 16 is also of conventional design and is illustrated schematically for purposes of describing the operation of the fire detection system 10. In addition to the overhead conveyor 22, the powder spray booth 16 includes an exhaust system 32 having a blower motor (not shown) to aid in the collection of oversprayed powder within the booth 16 and to provide for discharge of filtered air from the booth 16.

Powder is supplied to the spray gun 12 through a line 34 connected to a pump 36 which draws the powder from a feed hopper 38. The spray gun 12 is also connected to a high voltage source 40 for the purpose of imparting an electrostatic charge to the powder discharged from the nozzle 30 of spray gun 12.

As shown schematically in FIG. 1, a conventional interlock control system 42 controls all phases of the operation of spray booth 16. Control lines 44, 46, 48 and 50 extend from the control system 42 to the overhead conveyor motor 24, high voltage source 40, powder pump 36 and exhaust system 32, respectively. As discussed in detail below, the control system 42 is operable in response to a signal to immediately shut down all of the systems associated with spray booth 14 by sending signals through the control lines 44–50.

The fire detection system 10 is mounted within the interior of spray booth 16 to the spray gun 12. Although only one fire detection system 10 and spray gun 12 are illustrated in the figures, it should be understood that a separate fire detection system 10 is provided for each spray gun 12 in the booth 16. The fire detection system 10 comprises a lower rod 52 fixedly mounted to a bracket 54 secured to the rear mounting block 26 of spray gun 12. Preferably, the bracket 54 also carries the forward end of the powder line 34 from powder pump 36 which feeds powder to the spray gun 12. The lower rod 52 has an outer end 58 which extends forwardly of and beneath the spray gun nozzle 30. An anchor point 60 such as a recess is formed at the outer end 58 of lower rod 52.

An explosion-resistant switch 62 is mounted atop the rear mounting block 26 of spray gun 12, and includes a pair of contacts 64, 66. The contacts 64, 66 of switch 62 are connected by lines 68, 70, respectively, to the control system 42. The switch 62 is operable in an open position, with contacts 64, 66 apart, to send a signal to control system 42 as described in more detail below. A switch of the type suitable for use in this application is an Allen-Bradley limit switch, Catalog No. 802XA7, Series C, Nema-type 7 and 9.

An upper rod 72 is mounted to the switch 56 by a spring 74 and is movable with the contact 64 between an open position and a closed position with respect to contact 66. The upper rod 72 is formed with an outer end 76 which extends forwardly of the spray gun nozzle 30 in the same vertical plane as the lower rod 52. The upper rod 72 is formed with an anchor 78 at its outer end 76 of the same type as lower rod 52. Both of the rods 52, 72 are formed of a dielectric material.

As shown schematically in FIG. 1, a spring 80 mounted between an external support 73 and upper rod 72 to bias the switch 56 to an open position (not shown) in which the contacts 64, 66 are separated from one another. Alternatively, the spring 80 is mounted between the switch 62 and rear mounting block 26 of spray gun 12 to bias the contacts 64, 66 apart to an open position.

A fusible or burnable line or filament 82 is secured to the anchor points 60, 78 at the outer ends 58, 76 of the rods 52, 72, and tensioned so that the upper rod 72 is pulled downwardly toward the fixed, lower rod 52 to close the contacts 64, 66 of switch 62. The tension on the filament 82 which pulls upper rod 72 downwardly and closes switch 62 is sufficient to overcome the force of spring 80 urging the switch 62 to an open position, so that the switch 62 remains closed. Preferably, the filament 82 is positioned between the rods 52, 72 directly in the powder flow pattern 84 discharged by the nozzle 30 of spray gun 12. See FIG. 1.

In a presently preferred embodiment, the filament 82 is a co-extruded filament with a rigid polyester core 86 surrounded by a jacket of nylon 88. See FIG. 2. This co-extruded filament 82 is necessary to provide both the required resistance to abrasion from the finely ground powder discharged from nozzle 30 and the rigidity to maintain the movable upper rod 72 in position with respect to the fixed lower rod 52. The nylon jacket 88 exhibits good abrasion resistance but is stretchable. The polyester core 86 adds the required rigidity to filament 82 to avoid stretching but does not exhibit sufficient abrasion resistance to be used alone.

The fire detection system 10 functions as follows. In normal operating conditions, objects 18 are moved past the spray gun 12 by overhead conveyor 22 so that powder sprayed from nozzle 30 is deposited onto the surface of the objects 18. If an object 18 is not properly grounded, sparks can be produced which can ignite the highly combustible, finely ground powder discharged from the nozzle 30. In the event a spark from an object 18 ignites the powder discharged from nozzle 30, a fire is produced in the immediate area of the spray gun 12.

The filament 82 is located in the powder spray pattern 84 discharged from nozzle 30 so that any fire produced thereat immediately burns and severs the filament 82 produced which releases the upper rod 72 from tension. The spring 62 is then permitted to pivot the upper rod 72 upwardly so that the contacts 64, 66 are moved to an open position. In the open position of contacts 64, 66, the switch 62 is operable to send a shutdown or danger signal to control system 42 through lines 68, 70. The control system 42 then immediately sends signals through lines 44-50 to shut down the operation of each of all the spray booth systems. With the supply of powder stopped by the shut down of powder pump 36, the fire is immediately extinguished.

The entire sequence of burning the filament 82, sending a signal to control system 42 and shutting down the booth operation occurs in a fraction of a second. This is attributable, in part, to the fact that the filament 82 is located in immediate proximity to the spray gun nozzle 30 and in the powder spray pattern 84 where a fire would begin. The filament 82 is immediately burned and thus rendered inoperative in maintaining the contacts 64, 66 closed, so that a signal is immediately sent to the control system 42 to shut down the booth 16.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

What is claimed is:

1. A system for detecting fire in a powder spray booth including a spray gun having a nozzle, said spray gun being connected to a source of powder for discharging powder from the nozzle onto articles moving through the powder spray booth, comprising:

means for positioning a fusible element in close proximity to the nozzle of the spray gun;

means for activating a switch when said fusible element is exposed to fire in the powder spray booth;

means for sending a signal to a control system when said switch is activated, said control system being operable upon receipt of said signal to discontinue the flow of powder from the source to the spray gun to extinguish the fire.

2. In combination, a powder spray booth, a spray gun having a nozzle, said spray gun being connected to a source of powder for discharging powder from said nozzle onto articles moving through the powder spray booth, and a system for detecting fire in said powder spray booth, said system comprising:

means positioning a fusible element in the path of the powder discharged from said nozzle of said spray gun onto the articles in said powder spray booth;

means for activating a switch when said fusible element is exposed to fire in said powder spray booth;

means for sending a signal to a control system when said switch is activated, said control system being operable upon receipt of said signal to discontinue the flow of powder from the source to said spray gun to extinguish the fire.

3. A system for detecting fire in a powder spray booth including a spray gun having a nozzle, said spray gun being connected to a source of powder for spraying powder from said nozzle upon objects moving through the powder spray booth, comprising:

a switch movable between a first position and a second position, said switch being operable in said first position to send a signal to a control system, said control system being adapted to control the flow of powder from the source of powder to said spray gun;

means operatively connected to said switch for urging said switch to said first position;

retaining means mounted in close proximity to the nozzle of the spray gun, said retaining means being operable to retain said switch in said second position, said retaining means being rendered inoperative when exposed to fire in the spray booth to release said switch from said second position and permit said means operatively connected to said switch to urge said switch to said first position, said switch in said first position sending a signal to the control system to discontinue the flow of powder to said spray gun to extinguish the fire.

4. In combination, a powder spray booth, a spray gun having a nozzle, said spray gun being connected to a source of powder for spraying powder from said nozzle upon objects moving through said powder spray booth, and a system for detecting fire in said powder spray booth, said system comprising:

a switch movable between a first position and a second position, said switch being operable in said first position to send a signal to a control system, said control system being adapted to control the flow of powder from the source of powder to said spray gun;

means operatively connected to said switch for urging said switch to said first position;

retaining means mounted in close proximity to said nozzle of said spray gun, said retaining means being operable to retain said switch in said second position, said retaining means being rendered inoperative when exposed to fire in said spray booth to release said switch from said second position and permit said means operatively connected to said switch to urge said switch to said first position, said switch in said first position sending a signal to the control system to discontinue the flow of powder to said spray gun to extinguish the fire.

5. A system for detecting fire in a powder spray booth including a spray gun having a nozzle, the spray gun being connected to a source of powder for discharging powder from the nozzle onto objects moving through the powder spray booth, comprising:

a switch movable between a first position and a second position, said switch being operable in said first position to send a signal to a control system, said control system being adapted to control the flow of powder from the source of powder to the spray gun;

means operatively connected to said switch for urging said switch to said first position;

retaining means mounted in close proximity to the nozzle of the spray gun, said retaining means having a burnable element positioned in the path of the powder discharged from the nozzle of the spray gun;

said retaining means being operable to retain said switch in said second position, said retaining means being rendered inoperative when said burnable element is exposed to a fire in the booth to release said switch from said second position and permit said means operatively connected to said switch to urge said switch to said first position, said switch in said first position sending a signal to the control system to discontinue the flow of powder from the source to the spray gun to extinguish the fire.

6. A system for detecting fire in a powder spray booth including a spray gun having a nozzle, said spray gun being connected to a source of powder for spraying powder from the nozzle upon objects moving through the powder spray booth, comprising:

a switch movable between an open position and a closed position, said switch being operable in said open position to send a signal to a control system, said control system being adapted to control the flow of powder from the source of powder to the spray gun;

biasing means operatively connected to said switch for urging said switch to said open position;

switch closure means mounted in close proximity to the nozzle of the spray gun, said switch closure means being operable to retain said switch in said closed position, said switch closure means being rendered inoperative when exposed to fire in the spray booth to release said switch from said closed position and permit said biasing means to urge said switch to said open position, said switch in said open position sending a signal to the control system to discontinue the flow of powder to the spray gun to extinguish the fire.

7. The system of claim 6 in which said biasing means comprises a spring operatively connected to said switch, said spring being operable to bias said switch to an open position.

8. The system of claim 6 in which said switch closure means comprising:

a first rod fixedly mounted to the spray gun;

a second rod mounted to said switch and movable therewith between said open and closed positions;

said first and second rods having outer ends extending forwardly of the nozzle of the spray gun;

burnable means connected to said outer ends of said first and second rods for moving said second rod and said switch to a closed position, said burnable means being operable to releasably maintain said second rod and said switch in said closed position;

said burnable means being rendered inoperable when burned by fire to permit said biasing means to move said first rod and said switch to said open position.

9. The system of claim 8 wherein the first and second rods are constructed from non-conductive materials.

10. The system of claim 8 in which said burnable means is a co-extruded, non-conductive filament having a core formed of polyester material and an outer jacket surrounding said core formed of nylon material.

11. The method of detecting fire in a powder spray booth including a spray gun having a nozzle, said spray gun being connected to a source of powder to discharge powder from the nozzle onto articles moving through the powder spray booth, comprising:

positioning a fusible element in close proximity to the nozzle of the spray gun;

activating a switch when said fusible element is exposed to fire in the powder spray booth;

sending a signal to a control system when said switch is activated, said control system being operable upon receipt of said signal to discontinue the flow of powder from the source to the spray gun to extinguish the fire.

* * * * *